US009227439B1

(12) United States Patent
Katerberg et al.

(10) Patent No.: US 9,227,439 B1
(45) Date of Patent: Jan. 5, 2016

(54) PRINTERS HAVING ENCODERS FOR MONITORING PAPER MISALIGNMENTS

(71) Applicants: James Alan Katerberg, Kettering, OH (US); Michael Joseph Piatt, Dayton, OH (US)

(72) Inventors: James Alan Katerberg, Kettering, OH (US); Michael Joseph Piatt, Dayton, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/307,760

(22) Filed: Jun. 18, 2014

(51) Int. Cl.
*B41J 13/00* (2006.01)

(52) U.S. Cl.
CPC ..... *B41J 13/0009* (2013.01)

(58) Field of Classification Search
CPC ..... B41J 29/38; B41J 13/0009
See application file for complete search history.

(56) References Cited

U.S. PATENT DOCUMENTS 5,394,208 A 2/1995 Campbell
5,731,680 A * 3/1998 Winterberger et al. ..... 318/685
6,232,593 B1 * 5/2001 Taniguchi et al. ..... 250/231.13
7,530,659 B2 * 5/2009 Doherty et al. ..... 347/19
7,871,145 B1 1/2011 Enge
8,313,163 B2 * 11/2012 Eun et al. ..... 347/14
2006/0098073 A1 * 5/2006 Kawaguchi ..... 347/104
2006/0132523 A1 6/2006 Xie et al.
2009/0190104 A1 * 7/2009 Shibazaki ..... 355/27

FOREIGN PATENT DOCUMENTS

JP 10315559 A * 12/1998

OTHER PUBLICATIONS

U.S. Appl. No. 13/941,768, filed Jul. 15, 2013, Piatt et al.
U.S. Appl. No. 13/942,804, filed Jul. 15, 2013, Piatt.
U.S. Appl. No. 13/941,733, filed Jul. 15, 2013, Piatt et al.
U.S. Appl. No. 13/941,713, filed Jul. 15, 2013, Piatt et al.

* cited by examiner

*Primary Examiner* — Sarah Al Hashimi
(74) *Attorney, Agent, or Firm* — Peyton C. Watkins; William R. Zimmerli

(57) ABSTRACT

A printing system includes at least one print module for printing on a receiver media; a mechanism for moving the receiver media past the at least one print module; at least a first and second optical encoder sensor for measuring at least one of displacement and velocity of the receiver media which provides an output signal to a controller; wherein the controller, in response to the signals received from the at least two optical encoder sensors, controls the operation of the at least one print module.

20 Claims, 8 Drawing Sheets

PRINTERS HAVING ENCODERS FOR MONITORING PAPER MISALIGNMENTS

FIELD OF THE INVENTION

The present invention generally relates to printers having monitoring systems for monitoring print media as it moves through the printer and more specifically to printers having optical encoders which monitor in-track, cross-track, and skew misalignments.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms are categorized by technology as either drop on demand ink jet (DOD) or continuous ink jet (CIJ).

The first technology, "drop-on-demand" ink jet printing, provides ink drops that impact upon a recording surface by using a pressurization actuator (thermal, piezoelectric, etc.). One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink may be perturbed in a manner such that the liquid jet breaks up into drops of ink in a predictable manner.

Printing occurs through the selective deflecting and catching of undesired ink drops. Various approaches for selectively deflecting drops have been developed including the use of electrostatic deflection, air deflection and thermal deflection mechanisms.

There is a need in the CIJ industry to track the print media during the printing process. For example, US Patent Publication 2006/0132523 discloses a printer having a single 2D optical encoder having a coherent or quasi-coherent light source that reflects light from the print media that is received by a detector for tracking the motion of the print media.

Although satisfactory, this method includes shortcomings. One shortcoming is that the print media is monitored at only one location which limits the available information on the location of the print media. A second shortcoming, particularly in web-based systems, is that stretch of the print medium in the in-track and cross-track directions is not available. The present invention addresses and solves these shortcomings.

SUMMARY OF THE INVENTION

The present invention is directed to overcoming one or more of the problems set forth above. Briefly summarized, according to one aspect of the invention, the invention resides in a printing system includes at least one print module for printing on a receiver media; a mechanism for moving the receiver media past the at least one print module; at least a first and second optical encoder sensor for measuring at least one of displacement and velocity of the receiver media which provides an output signal to a controller; wherein the controller, in response to the signals received from the at least two optical encoder sensors, controls the operation of the at least one print module.

These and other objects, features, and advantages of the present invention will become apparent to those skilled in the art upon a reading of the following detailed description when taken in conjunction with the drawings wherein there is shown and described an illustrative embodiment of the invention.

Advantageous Effect of the Invention

The present invention has the advantage of simplifying the integration of a printing module with an existing print medium transport by coupling print medium motion tracking sensors directly with the print module. The invention also enables the detection of print medium travel-direction shifts and print medium distortion as the print medium enters the print zone, permitting the printer controller to compensate for detected travel-direction shifts and medium distortion.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Before describing the present invention, it is beneficial to understand some of the terms used herein. In this regard, inkjet printing is commonly used for printing an ink on paper. However, there are numerous other materials in which inkjet is appropriate. For example, vinyl sheets or films, plastic sheets or films, circuit boards, textiles, paperboard, and corrugated cardboard can comprise the "print medium" (singular form) or "print media" (plural form) as used herein whether used in a web format or a cut sheet format. The term "print media units" (individual sheets of paper, cardboard, assembled boxes, circuit board material, or other discrete or individual objects to be printed) is included within "print media" as used herein. Additionally, although the term inkjet is often used to describe the printing process, the term jetting is also appropriate wherever ink or other liquids is applied in a consistent, metered fashion, particularly if the desired result is a thin layer or coating.

As described herein, the example embodiments of the present invention may be used in printing systems, including inkjet printing systems that include a printhead or printhead components. Many applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Figure 1:
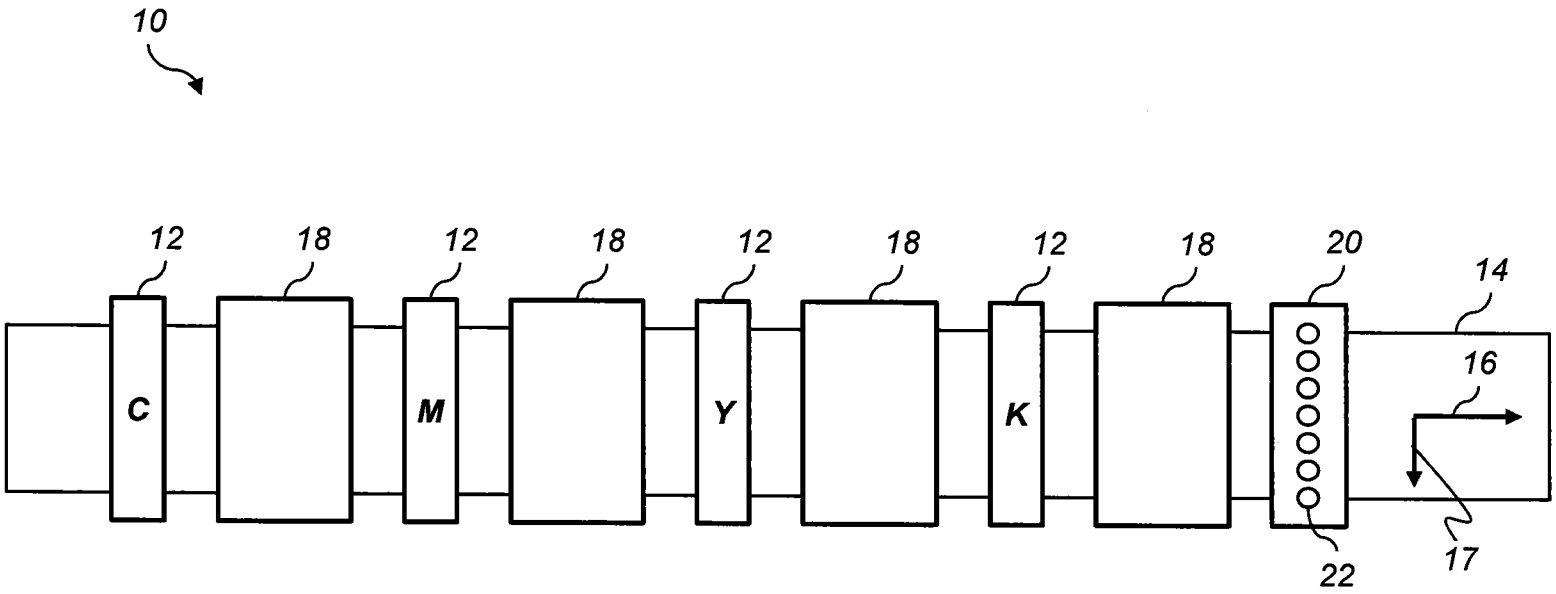
FIG. 1 shows a diagram illustrating a multi-channel digital printing system of the present invention.

FIG. 1 shows a diagram illustrating a multi-channel digital printing system 10 of the present invention for printing on a web of print medium 14. The printing system 10 includes a plurality of print modules 12, each adapted to print image data for an image plane corresponding to a different color channel. In some printing systems 10, the print modules 12 are inkjet print modules adapted to print drops of ink onto the print medium 14 through an array of inkjet nozzles. In other cases, the print modules 12 can be electro-photographic print modules that produce images by applying solid or liquid toner to the print medium 14. Alternately, the print modules 12 can utilize any type of digital printing technology known in the art.

In the illustrated example, the print modules 12 print cyan (C), magenta (M), yellow (Y) and black (K) colorants (e.g., inks) onto the print medium 14 as it is transported through the printing system using a media transport system (not shown in FIG. 1) from an upstream to a downstream in a print medium direction of travel 16. The print medium direction of travel 16 is commonly referred to as the "in-track direction," and the direction perpendicular to the print medium direction of travel 16, which is within the plane of the print medium 14 is commonly referred to as the "cross-track direction" 17. In other cases, the print modules 12 may be adapted to print different numbers and types of colorants. For example, additional print modules 12 may be used to print specialty colorants, or extended gamut colorants. In some cases, a plurality of the print modules 12 may be used to print the same colorant (e.g., black), or density variations of the same color (e.g., gray and black). In some cases, the printing system 10 is adapted to print double-sided pages. In this case, one or more of the print modules 12 may be arranged to print on a back side of the print medium 14.

The printing system 10 also includes dryers 18 for drying the ink applied to the print medium 14 by the print modules 12. While the exemplary printing system 10 illustrates a dryer 18 following each of the print modules 12, this is not a requirement. In some cases, a single dryer 18 is used following the last print module 12, or dryers 18 are only provided following some subset of the print modules 12. Depending on the printing technology used in the print modules 12, and the printing speed, it may not be necessary to use any dryers 18.

Downstream of the print modules 12, an imaging system 20, which can include one or more imaging devices 22, is used for capturing images of printed images on the print medium 14. In some cases, the imaging system 20 can include a single imaging device 22 that captures an image of the entire width of the print medium 14, or of a relevant portion thereof. In other cases, a plurality of imaging devices 22 may be used, each of which captures an image of a corresponding portion of the printed image. In some embodiments, the position of the imaging devices 22 may be adjusted during a calibration process to sequentially capture images of different portions of the print medium 14. For cases where the printing system 10 prints double-sided images, some of the imaging devices 22 may be adapted to capture images of a second side of the print medium 14.

In some cases, the imaging devices 22 may be digital camera systems adapted to capture 2-D images of the print medium 14. In other embodiments, the imaging devices 22 can include 1-D linear sensors that are used to capture images of the print medium 14 on a line-by-line basis as the print medium 14 moves past the imaging system 20. The imaging devices 22 can equivalently be referred to as "cameras" or "camera systems" or "scanners" or "scanning systems," independent of whether they utilize 2-D or 1-D imaging sensors. Similarly, the images provided by the imaging devices 22 may be referred to as "captured images" or "scanned images" or "scans." In some cases, the imaging devices 22 include color sensors for capturing color images of the print medium, to more easily distinguish between the colorants deposited by the different print modules 12.

Figure 2:
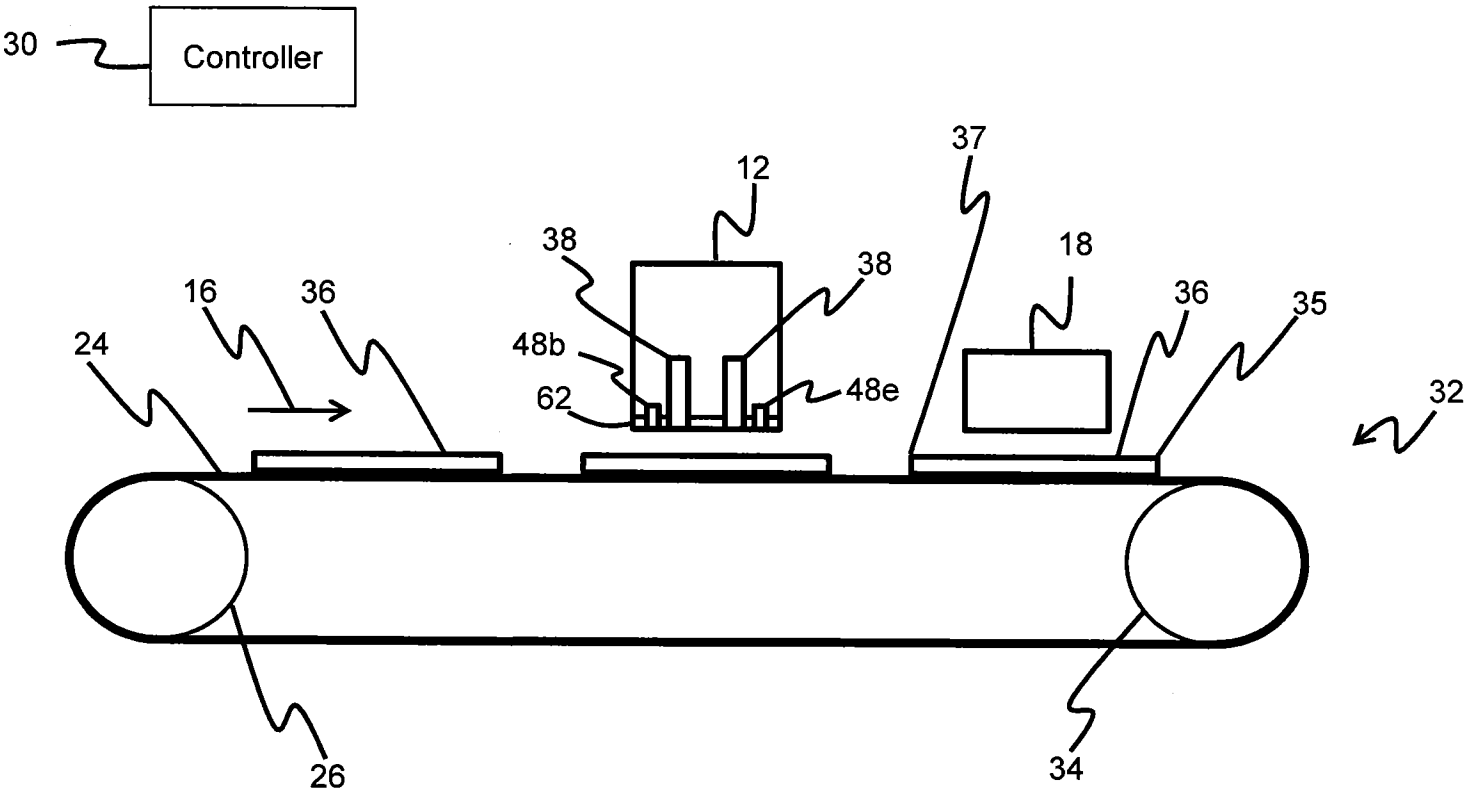
FIG. 2 shows a simplified side view of a cut-sheet embodiment of a printing system of the present invention.

FIG. 2 shows a simplified side view of a cut-sheet embodiment of a printing system, individual units of print media, referred to herein as print media units 36, such as individual sheets of paper or cardboard, assembled boxes, circuit board material, or other discrete or individual objects to be printed, are conveyed by the transport system 32 past one or more print modules 12. The transport system includes an endless belt 24 wrapped around a drive roller 26 and an idler roller 34. A motor (not shown) is coupled to the drive roller. The print media units 36 are placed on the transport system 32 by a feed system, which is not shown, and are conveyed from left to right past one or more print modules 12 and dryers 18. The print media units 36 are then transferred into a receiving unit, such as a stacker, not shown. The print media units 36 are typically secured to the endless belt 24 so that they move with the endless belt 24 by various mechanisms such as an applied electrostatic charge, vacuum applied through holes in the endless belt, or even the weight of the print media units 36; these methods each are well known in the art.

Figure 3:
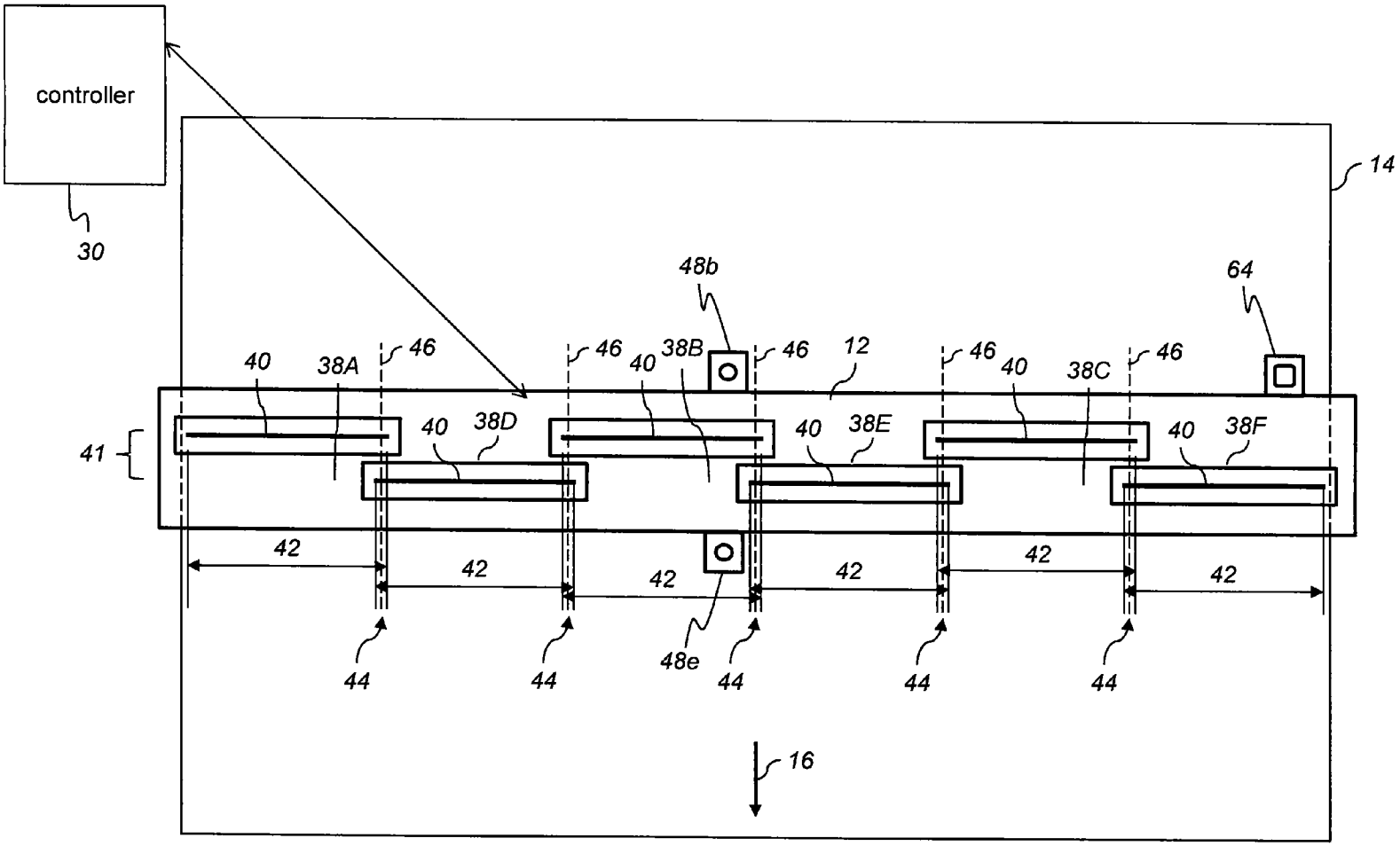
FIG. 3 is a diagram of an exemplary print module of the present invention.

FIG. 3 is a diagram of an exemplary print module 12. In this configuration, the print module 12 is an inkjet printing system 10 that includes a plurality of inkjet printheads, referred to as 38 collectively and 38A through 38F when referred to individually, arranged across a width dimension of the print medium 14 in a staggered array configuration. The inkjet printheads 38 are arranged in two staggered rows. The print zone 41 of the print module 12 spans from the nozzle array of the upstream row of the inkjet printheads 38 to the nozzle array of the downstream row of inkjet printheads 38. The width dimension of the print medium 14 is the dimension perpendicular to the print medium direction of travel 16. Such print modules 12 are sometimes referred to as "lineheads."

Each of the inkjet printheads 38 includes a plurality of inkjet nozzles arranged in nozzle array 40, and is adapted to print a swath of image data in a corresponding printing region 42. In the illustrated example, the nozzle arrays 40 are one-dimensional linear arrays, but the present invention is also applicable to inkjet printheads 38 having nozzles arrayed in two-dimensional arrays as well. Common types of inkjet printheads 38 include continuous inkjet (CI) printheads and drop-on-demand (DOD) printheads. Commonly, the inkjet printheads 38 are arranged in a spatially-overlapping arrangement where the printing regions 42 overlap in overlap regions 44. Each of the overlap regions 44 has a corresponding boundary 46 between the print region 42 of one printhead 38 and the print region 42 of the adjacent printhead 38. In the overlap regions 44, nozzles from more than one nozzle array 40 can be used to print the image data.

Stitching is a process that refers to the alignment of the printed images produced from multiple inkjet printheads 38 for the purpose of creating the appearance of a single page-width line head. For example, as shown in FIG. 3, six inkjet printheads 38, each with nozzle arrays 4.16 inches in length, may be stitched together at overlap regions 44 to form eighteen 24.5 inch page-width print module 12. The page-width image data is processed and segmented into separate portions by a controller 30 that are sent to each inkjet printhead 38 with appropriate time delays to account for the staggered positions of the inkjet printheads 38. The image data portions printed by each of the inkjet printheads 38 are sometimes referred to as "swaths." Stitching systems and algorithms are used to determine which nozzles of each nozzle array 40 should be used for printing in the overlap region 44. Preferably, the stitching algorithms create a boundary between the printing regions 42 that is not readily detected by an eye. One such stitching algorithm is described in commonly-assigned U.S. Pat. No. 7,871,145 to Enge, entitled "Printing method for reducing stitch error between overlapping jetting modules," which is incorporated herein by reference.

Figure 8:
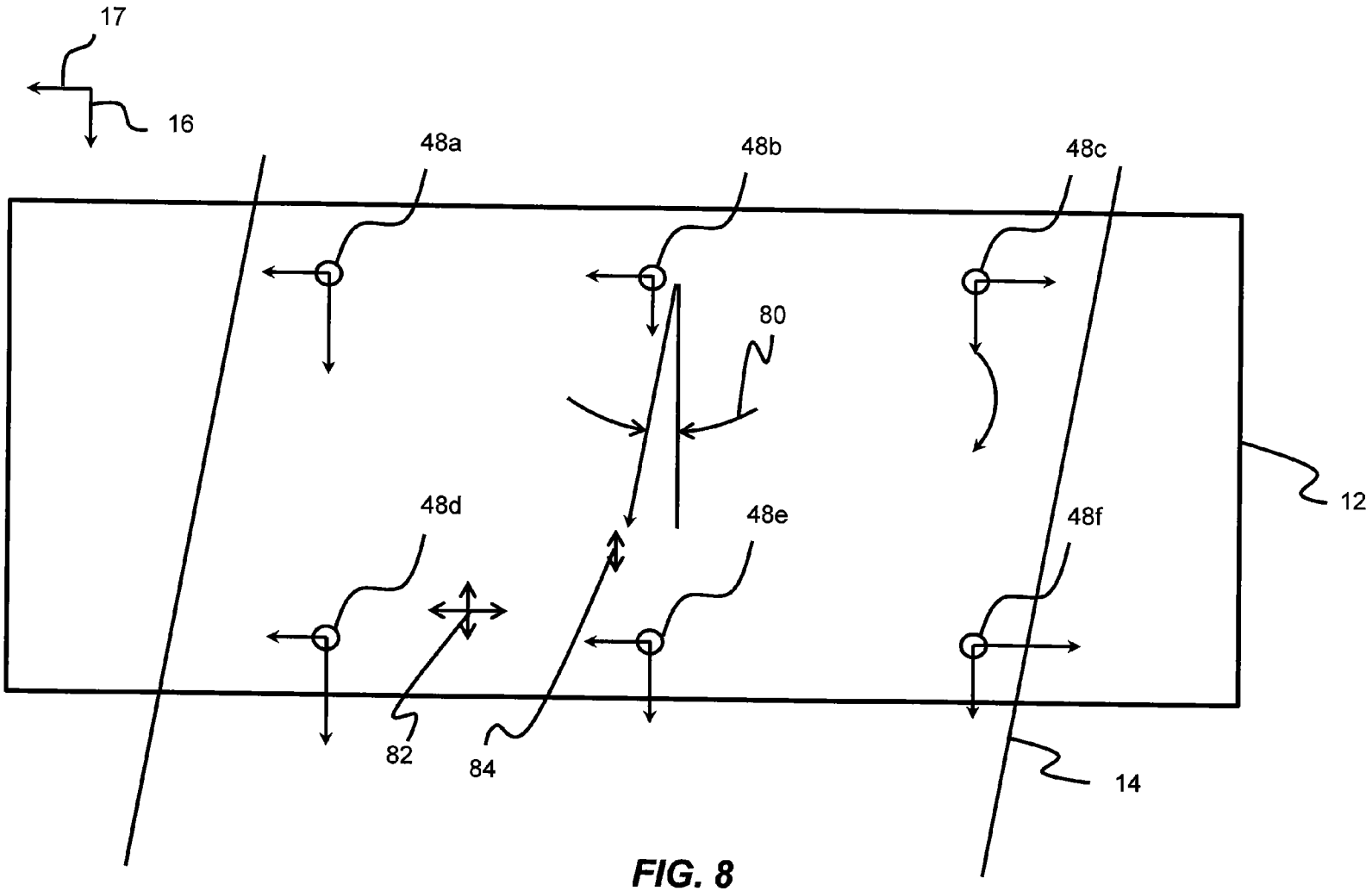
FIG. 8 is an illustration of a print medium as it passes various optical encoder sensors attached to or integrated into a print module.

The printing system 10 includes a controller 30 that is electrically connected to the print module 12 for controlling at least one operation of the print module 12. The operations may include, but are not limited to, starting and shutting down of the print module 12 in a manner that ensures reliable operation, receiving image data and processing such data to produce print signals which it supplies to the inkjet printheads 38 within the print module 12. The controller 30 also stores calibration data to calibrate the first and second sensors relative to each other. Before discussing the optical encoder sensors 48, it is beneficial to note the number/lettering system as clearly shown in FIG. 8. For the various embodiments the optical encoders will be labeled 48*a*-48*f* by position as shown in FIG. 8. For convenience, the optical encoder sensors are referred to as 48 when referred to generically in one embodiment or to all embodiments as will be readily apparent.

Referring back to FIG. 3, there are one or more optical encoder sensors 48*b* attached to the print module 12 (FIG. 2), upstream of the print zone 41, only one is shown for simplicity. Also attached to the print module 12, downstream of the print zone 41, is one or more optical encoder sensors 48*e*, again only one is shown for simplicity. Each of the optical encoder sensors 48*b* and 48*e* is oriented to direct light at the print medium 14, detect the light scattered off the print medium 14, and from analysis of the detected light to provide a measure at least one of displacement and velocity of the print medium 14 in one or preferably two orthogonal directions as the print medium 14 passes through the print zone 41. In some embodiments, the optical encoder sensor 48*b* and 48*e* captures a sequence of images of light reflected off the print medium 14, and determines a translational shift of the print medium 14 between the analyzed captured images using one or more image correlation algorithms. The optical encoder sensors 48*b* and 48*e* may be, but are not limited to, the type ADNS-9800 from PixArt Imaging Inc. The output of such sensors is typically a sequence of encoder pulses for each orthogonal axis of measurement, where each encoder pulse represents a defined displacement shift. In other embodiments, the optical encoder sensors 48*b* and 48*e* include a sensor for detecting Doppler shifted light from which the velocity of the print medium 14 may be determined. The LaserSpeed 4000 from Beta LaserMike and the LSV-2000 from Polytec are examples of one dimensional Doppler based sensors, but they may be paired together and oriented to provide two orthogonal axis of measurement. The output of the Doppler shift based sensors is typically processed to generate encoder pulses that correspond to displacement shifts of a defined amount.

The one or more upstream optical encoder sensors 48*b* provide one or more measurements of the displacement or velocity of the print medium 14 as it approaches the inkjet printheads 38 of the print module 12. The one or more downstream optical encoder sensors 48*e* provide one or more measurements of the displacement or velocity of the print medium 14 after it has gone past the inkjet printheads 38 of the print module 12.

Referring back to the cut sheet printing system of FIG. 2, the upstream optical encoder sensors 48*b* begin to detect the motion of a print medium 14 (FIG. 3) and to generate the corresponding encoder pulse train once the leading edge 35 of the of the print medium unit 36 passes under the upstream optical encoder sensor 48*b*. The upstream optical encoder sensor 48*b* can continue to track the motion of the print medium unit 36, and to generate an appropriate encoder pulse train, until the trailing edge of the print medium unit 36 passes the upstream optical encoder sensor 48*b*. In a similar manner, the downstream optical encoder sensor 48*e* can track the motion of the print medium unit 36 from the time that the leading edge 35 of the print medium unit 36 passes the downstream optical encoder sensor 48*e* until the trailing edge 37 of the print medium unit 36 passes the downstream optical encoder sensor 48*e*. As a print medium unit 36 passes the print module 12, initially only the upstream optical encoder sensor 48*b* provides encoder pulses. The upstream optical encoder sensor 48*b* therefore serves as the primary encoder during this time. Once the leading edge 35 passes the downstream optical encoder sensor 48*e*, both upstream and downstream optical encoder sensors 48*b* and 48*e* provide encoder pulses to the controller 30. When the trailing edge 37 of the print medium unit 36 passes the upstream optical encoder sensor 48*b*, the encoder pulse train from the upstream optical encoder sensor 48*b* stops, while the encoder pulse train from the downstream optical encoder sensor 48*e* continues. During this time the downstream optical encoder sensor 48*e* serves as the primary encoder. The encoder pulse train from the downstream optical encoder sensor 48*e* continues until the trailing edge 37 of the print medium unit 36 passes the downstream optical encoder sensor 48*e*. The controller 30 receives and processes the output of both the upstream and downstream optical encoder sensors 48*b* and 48*e* to enable the controller 30 to track the motion of the print medium unit 36 the whole time it is passing through the print zone 41 (FIG. 3) of the print module 12, and to control the print operation of the print module 12 so that it can control the timing of the printing of successive row of pixels so that they are printed appropriately onto the print medium unit 36. The processing of the output of the upstream and downstream optical encoder sensors 48*b* and 48*e* involves managing the transition from the upstream optical encoder sensor 48*b* serving as the primary encoder to the downstream optical encoder 48*e* serving as the primary encoder. As there can be an arbitrary phase shift between the encoder pulse trains from the upstream and downstream optical encoder sensors 48*b* and 48*e*, the processing of the output of both optical encoder sensors 48*b* and 48*e* can include identification of such a phase shift and phase shifting the pulse train of one of the optical encoder sensors (typically the downstream optical encoder sensor 48*e*) so that during a phase transition when the role of primary encoder is transitioned from the upstream optical encoder sensor 48*b* to the downstream optical encoder sensor 48*e*. If there is a possibility that an encoder pulse train from one of the optical encoder sensors 48 could have momentary drop out due perhaps to a momentary loss of contrast on the print medium 14, then the controller 30 sends synthesis pulses to eliminate the drop out. Depending on the spacing of the print medium units 36 on the endless belt 24 of the transport system 32, it is possible for the upstream optical encoder 48*b* to begin generating an encoder pulse train tracking the motion of a particular print medium unit 36, while the downstream optical encoder sensor 48*e* is still generating an encoder pulse train tracking the motion of the preceding print medium unit 36. If there is a possibility that there can be relative movement between the print medium units 36 on the endless belt 24, then the controller 30 should process the encoder pulse trains in a manner that avoids merging the pulse trains associated with different print medium units 36.

In a preferred embodiment, at least two optical encoder sensors 48*b* and 48*e* are in line with each other; the line being oriented parallel to the direction of travel 16 of the receiver media relative to the print module 12. By locating at least two optical encoder sensors 48*b* and 48*e* in this manner, the at least two optical encoder sensor 48*b* and 48*e* each measure the print media velocity at the same cross-track position of the print media 14 so that their velocity measurements are less likely to be affected by any potential variations in the print media speed across the width of the print media 14.

As seen in FIG. 3, a cue sensor 64 is also attached to the print module 12 upstream of the inkjet printheads 38 of the print module 12. The cue sensor 64 is used to detect the transit of a printed cue mark on the print medium 14 or to detect the transit of the leading edge 35 (see FIG. 2) of the print medium units 36 (see FIG. 2). The controller 30 receives the cue signals from the cue sensors 64 and controls the start of print on the print medium 14 after an appropriate cue delay from the detected cue signal. The cue delay is typically measured in terms of a number of encoder pulses rather than in units of time. As the cue delay is measured as a number encoder pulses, it is necessary for the upstream optical encoder sensor 48*b* to detect the print medium units 36 and to generate encoder pulses either concurrently with or prior to the detection of the cue mark or the leading edge 35 of the print medium unit 36 by the cue sensor 64, or the motion of the print medium 14 between the detection of the cue mark and the detection of the print medium 14 by the optical encoder sensor 48*b* will be unaccounted for. In some embodiments, the start of the encoder pulse train from the optical encoder sensor 48*b* can serve as a cue signal. Alternatively, optical encoder sensors 48, such as ADNS-9800, provide as outputs the minimum, maximum, and average detected pixel intensity values, which may be analyzed by the controller 30 to generate cue signals. In such embodiments, the optical encoder sensors 48, also serve as cue sensors.

Figure 4:
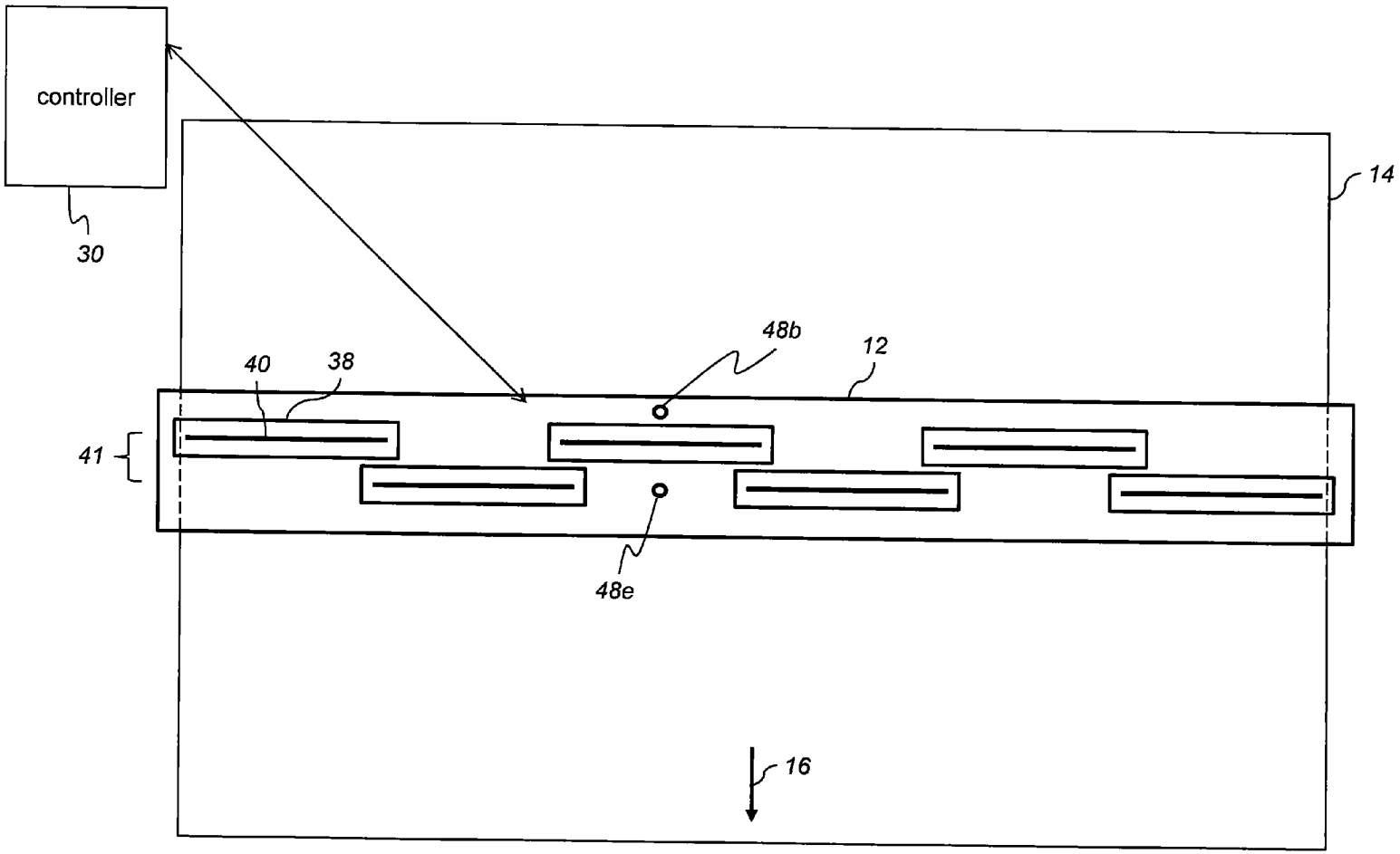
FIG. 4 is a bottom view of another embodiment of a print module of the present invention having a plurality of inkjet printheads.

Referring to FIG. 4, there is shown a bottom view of another embodiment of a print module 12 having a plurality of inkjet printheads 38 with each inkjet printhead 38 having a nozzle array 40. In this embodiment, the print module 12 includes two optical encoder sensors 48*b* and 48*e* integrated to a print module 12 rather than attached to the leading edge 35 and trailing edge 37 of the print module 12; each optical encoder sensor 48 measures at least one of displacement and velocity of the print medium 14 in one or preferably two orthogonal directions as it passes in the print zone 41. The optical encoder sensors 48*b* and 48*e* are preferably disposed in-line with each other, parallel to the print medium direction of travel 16, and in the central region of the print module 12. As with the previous embodiment, one optical encoder sensor 48*b* is located upstream of the print zone 41 and another optical encoder sensor 48*e* is located downstream of the print zone 41. The two optical encoder sensors 48 are located at the same cross-track position on the print module 12, so that the optical encoder sensors 48 lie on a line that is parallel to the direction of receiver media travel relative to the printing module. The integration of the optical encoder sensors 48 into the print module 12, with the optical encoder sensors 48 viewing the print medium 14 through openings 54 (see FIG. 7) in the support structure of the print module 12 permits the upstream and downstream optical encoder sensors 48*b* and 48*e* to be placed closer together and closer to the rows of printheads in the print module 12. This permits the controller 30 to more accurately track the motion of the print medium as it passes through the print zone 41 of the print module 12, permitting for more accurate placement of the print from the printheads 38 of the print module 12.

Figure 5:
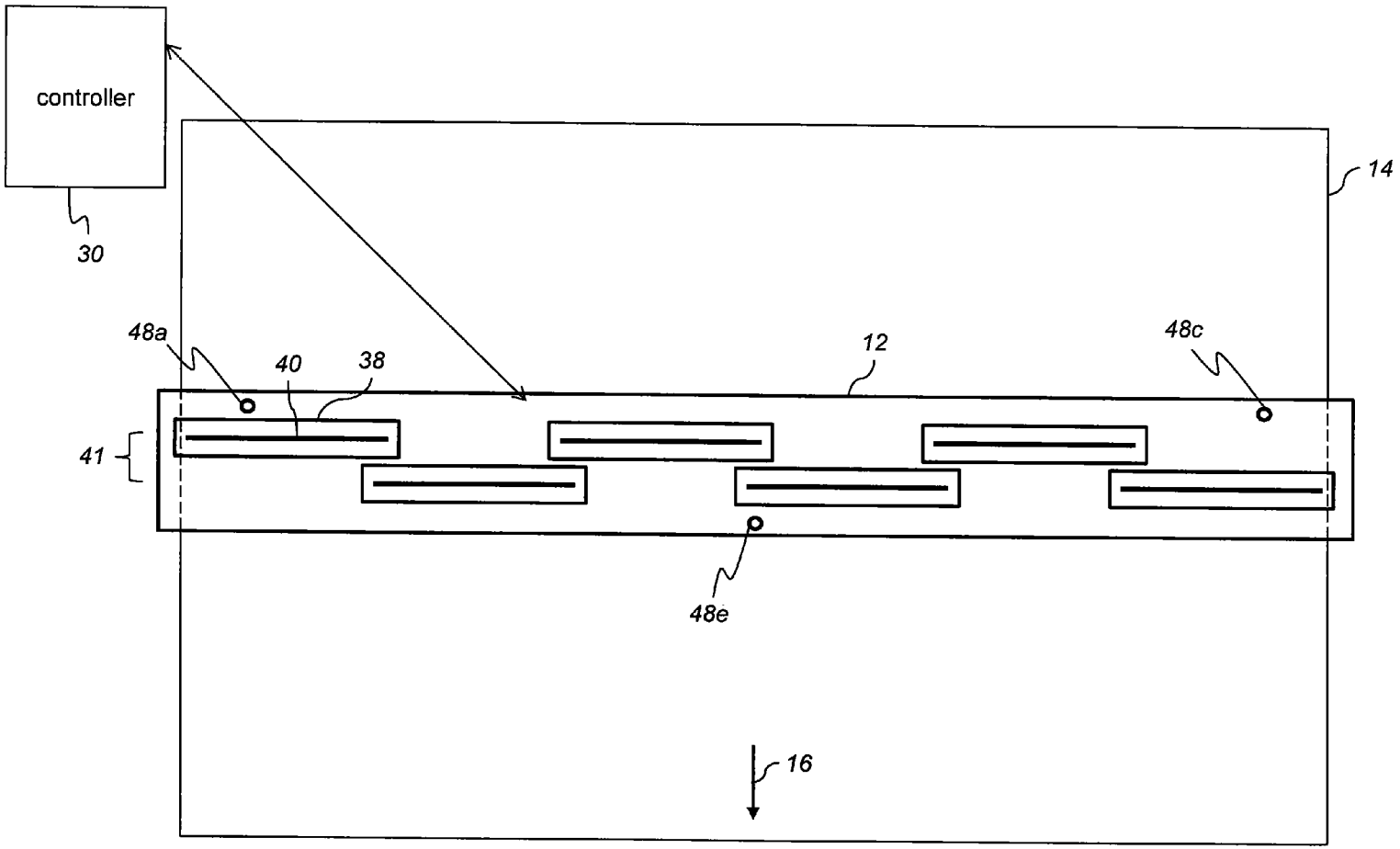
FIG. 5 is another embodiment of the present invention having three optical encoder sensors.

Referring to FIG. 5, there is shown another embodiment of the present invention. In this embodiment, there are three optical encoder sensors 48 each measuring in two directions of at least one of displacement and velocity of the print medium 14 as it passes in the print zone 41, and each optical encoder sensor 48 outputs its signals to the controller 30. In this embodiment, two optical encoder sensors 48*a* and 48*c* are located upstream of the print zone 41, at a common distance upstream of the first or upstream row of inkjet printheads 38 in the print module 12. The third optical encoder sensor 48*e* is located downstream of the print zone 41 of the print module 12. In this embodiment, the downstream optical encoder sensor 48*e* is positioned at the same cross-track position as the midpoint between the two upstream optical encoder sensors 48*a* and 48*e*. With the third optical encoder sensor 48*e* at this cross-track position, the measured receiver media velocities are about equal to the average of the velocities measured by the two upstream optical encoder sensors 48*a* and 48*c* even if there is a velocity variation across the width of the print medium 14. In an alternate embodiment, the downstream optical encoder sensor 48*e* is located at the same cross-track position as one of the two upstream optical encoder sensors 48*a* or 48*c*. The controller 30 receives and processes the signals from these optical encoder sensors 48 in its control of the printing operation of the print module 12 to control the print timing of successive rows of pixels.

Figure 6:
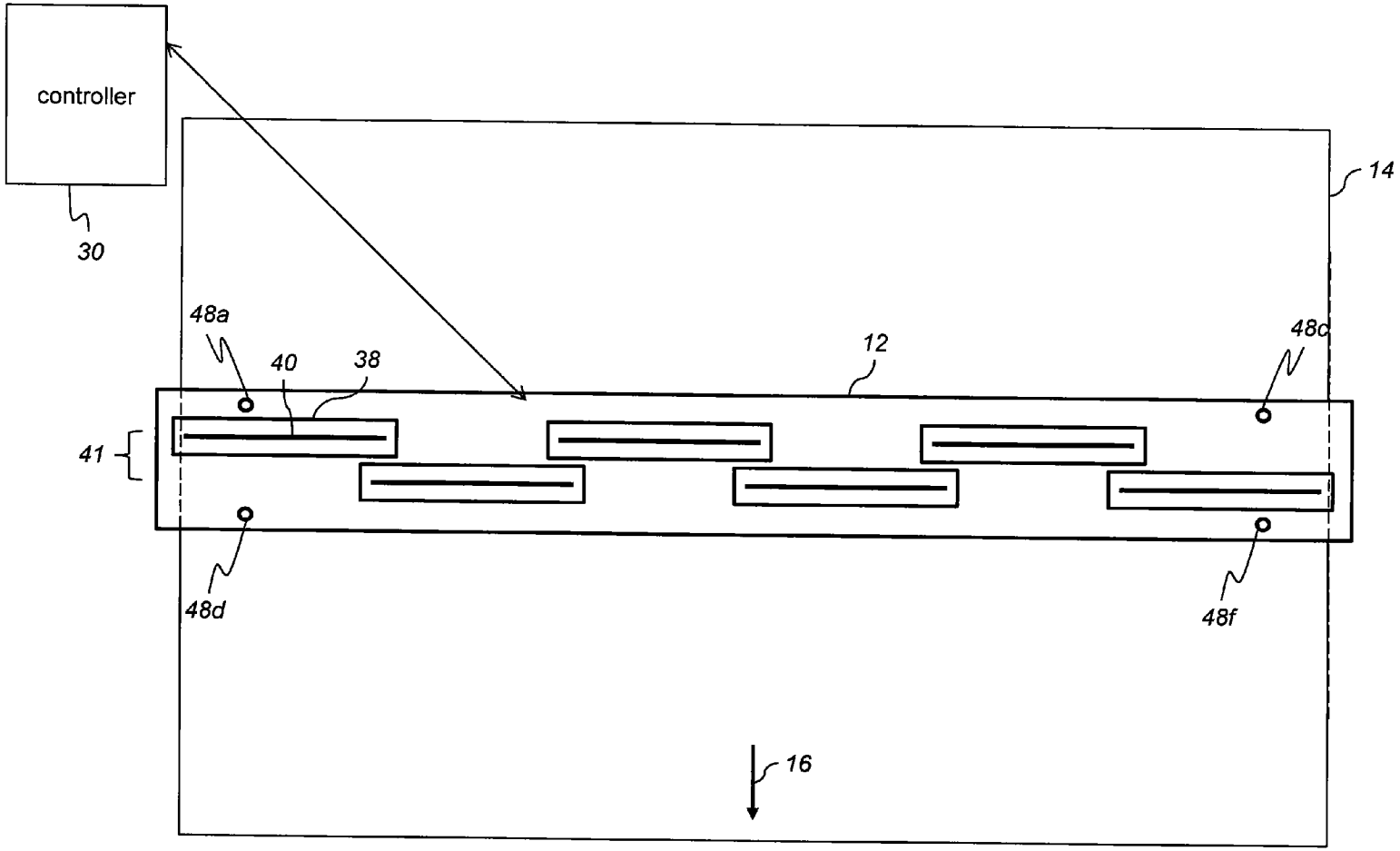
FIG. 6 is another embodiment of the present invention having four optical encoder sensors.

Referring to FIG. 6, another embodiment of the present invention is shown. In this embodiment, there are four optical encoder sensors 48*a*, 48*c*, 48*d* and 48*f* (generically referred to as 48) each measuring at least one of displacement and velocity of the print medium 14 as it passes in the print zone 41, and as before, each optical encoder sensor 48 outputs their signal to the controller 30. The controller 30 receives and processes the signals from these optical encoder sensors 48 in its control of the printing operation of the print module 12 to control the print timing of successive rows of pixels.

Figure 7:
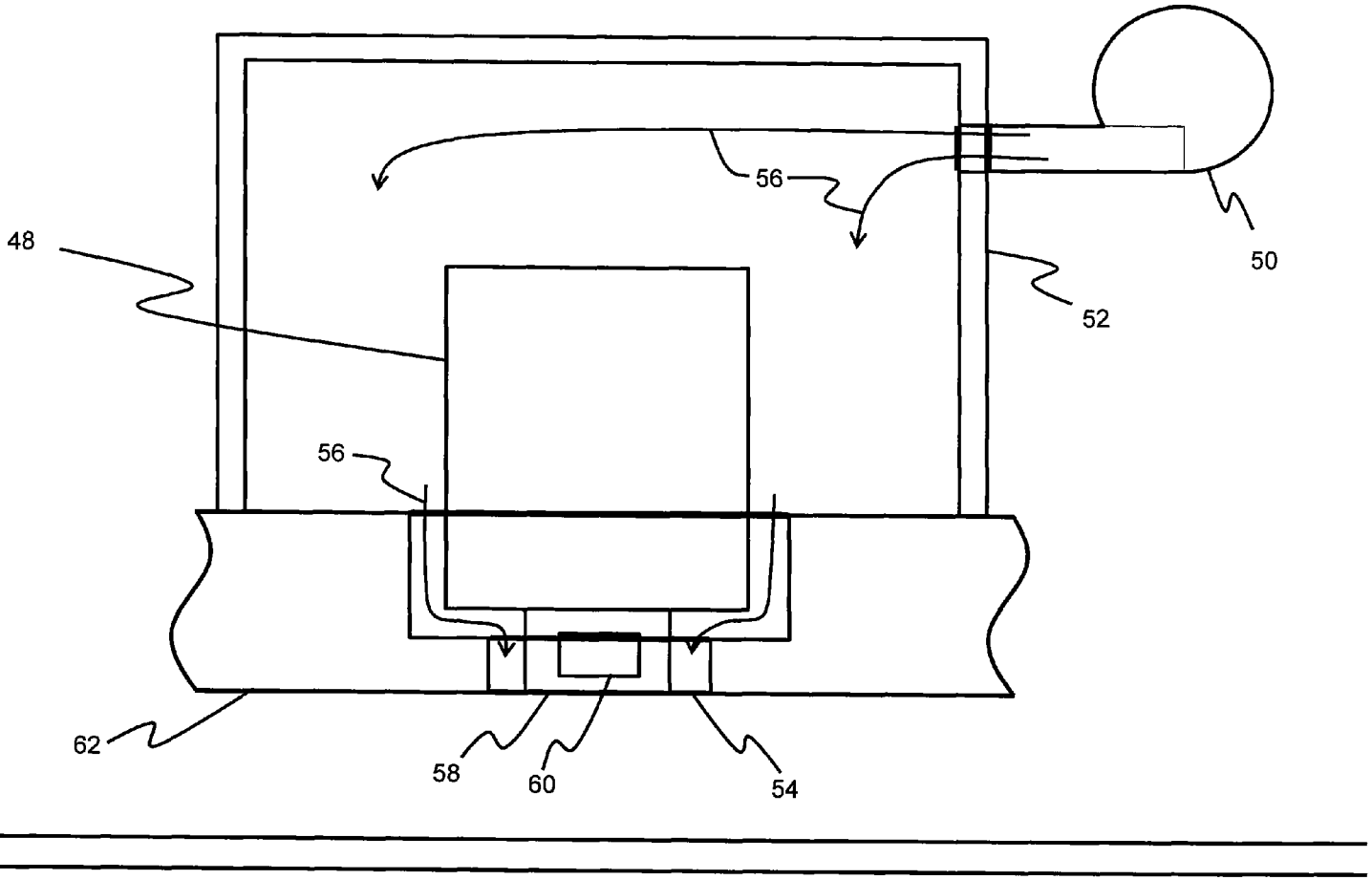
FIG. 7 provides a flow of clean, dry air over the optical encoder sensor for maintaining cleanliness.

Referring to FIG. 7, as the environment between the print module 12 and the print medium 14 can have high relative humidity and include mist or spray from the impact of the print drops on the print media 14, some embodiments provide a flow of clean dry air over the optical encoder sensor 48 for maintaining the cleanliness of the optical encoder sensors 48. FIG. 7 shows a cross section view of such an embodiment. A blower 50 directs a flow of clean dry (or low humidity) air 56 into an enclosure 52 around the optical encoder sensor 48. The air flows out of the enclosure through an opening 54 in the support structure 62 (also shown in FIG. 2), around lens 58 or sensing window of the optical encoder sensor 48. Such a clean air system is disclosed in U.S. Pat. No. 5,394,208 which is incorporated herein by reference. In some embodiments, a heater 60 is also disposed adjacent to the lens 58 of each optical encoder sensor 48 for heating the optical encoder sensors 48 above the dew point to prevent condensation from forming on the optical encoder sensors 48.

FIG. 8 is an illustration of the print medium 14 as it passes the various optical encoder sensors 48 attached to or integrated into a print module 12. As discussed earlier, the placement of one optical encoder sensor 48 upstream of the print zone 41 of a print module 12 and another optical encoder sensor 48 downstream of the print zone 41 provides a useable optical sensor encoder 48 for the entire time a print medium unit 36 is passing through the print zone 41 in a cut sheet printing system 10. When the print medium unit 36 is in the field of view of multiple optical encoder sensors 48, the controller 30 can process the signals from the optical encoder sensors 48 to glean information that can aid in controlling the print modules 12 to enhance printhead to printhead stitching and color to color registration. Six optical encoder sensors are shown, labeled 48*a*-48*f*. The six optical encoder sensors 48 of this figure can represent another embodiment of the present invention, but also by selecting different subsets of these optical encoder sensors 48 it is also possible to illustrate how information may be gleaned from the previously discussed embodiments.

In an ideal printing system 10 with ideal print medium 14, the print medium 14 would move at an in-track velocity that is constant in time and that is uniform throughout the printing region. The print medium 14 would also have a spatially uniform cross-track velocity that is equal to zero. Therefore in the ideal world, all the optical encoder sensors 48*a*-48*f* would have the same in-track velocity and they each would have a cross track velocity of zero. If the in-track velocity measured by an upstream optical encoder sensor such as 48*b* is not equal to the in-track velocity of the corresponding downstream optical encoder sensor 48*e*, it indicates that the print medium 14 is undergoing a change in-track strain. The controller 30 can then adjust the timing of the rows of pixels printed from the either or both the first and the second rows of printheads 38 to account for the print medium 14 strain to ensure in-track stitching of the two rows of printheads 38.

If velocity is spatially uniform but the cross-track velocity measured by the different optical encoder sensors 48 is not zero, it may be an indication that the print media 14 is passing the optical encoder sensors 48 at a skew angle 80. Such a skew angle 80 can affect stitching of the print from the two rows of printheads 38 in the print module 12. For example, if the print medium 14 is passing under the print module 12 with the skew angle 80, then the cross track gap at the stitch between printheads 38A and 38D (FIG. 3) will be larger than normal and the cross track gap at the stitch between printheads 38B and 38D will be smaller than normal. The controller 30, upon detecting the skew angle 80 from the non-zero cross-track velocity, can adjust the stitching to account for the media travel skew. Furthermore, the controller 30 can apply a skew correction to tilt cross-track lines to make them square to the print medium 14. While skew angle 80 may be detected with a single optical encoder sensor 48, the analysis of both the in-track and the cross-track velocity data from two or more optical encoder sensors 48 is of value for determining the uniformity of the skew and whether the detected skew angle 80 is the result of some other phenomena such as a rotation of the print medium 14.

If the in-track velocity measured by the optical encoder sensor 48*c* is larger than the in-track velocity measured by optical encoder sensor 48*a*, the measurements indicate that a print medium unit 36 (such as a sheet of paper or cardboard) may be rotating around a vertical axis as it is passing under print module 12 in a cut sheet printing environment. In a web printing system, the difference in in-track velocity across the print medium 14 indicates a non-uniform strain in the print medium 14 across the width of the print medium 14. This indicates that the print medium 14 may have some curvature around a vertical axis. Such rotation or curvature of the print medium 14 is also detectable by analysis of the cross-track velocity measurements from the two rows of the optical encoder sensors 48, such as by optical encoder sensors 48*b* and 48*e*. Once the analysis of the optical encoder sensor data identifies such a rotation or a curvature of the print medium 14, the controller 30 can determine the print corrections to be made to ensure registration and stitching. While such a rotation or curvature of the print medium 14 may be detected using only single component of velocity data from only two optical encoder sensors 48, the analysis of both the in-track and the cross-track velocity data from three or more optical encoder sensors 48 is of value for determining the radius of curvature and the location of the rotation axis.

During the printing process, the print medium 14 tends to expand in the cross-track direction 17 when moisture is added to it, and it contracts when moisture is removed from the print medium 14. Width changes in the cross-track as the print medium 14 approaches the print zone 41 may be identified by differences in the cross-track velocity measured by optical encoder sensors 48*a* and 48*c*. For example, if both these optical encoder sensors 48 show a cross track velocity directed away from the centerline of the print medium 14, then the print medium 14 is expanding in the cross-track direction 17 as it is approaching the print zone 41. Similarly, differences in the cross-track velocity measured by optical encoder sensors 48*d* and 48*f* indicate a changing width of the print medium 14 as it is leaving the print zone. The controller 30 (FIG. 3), through analysis of the cross-track velocity differences measured by optical encoder sensors 48*a* and 48*c* and or by optical encoder sensors 48*d* and 48*f*, can identify such cross-track expansion and contraction of the print medium 14, and can adjust the print width and cross-track position of the image being printed in the print zone 41 to improve the stitching and registration of the images. The controller 30 can further improve the stitching and registration of the images by including in the analysis measurements of the cross-track velocity measured by either or both optical encoder sensors 48*b* and 48*e*. By including in the analysis of cross-track expansion or contraction, the cross-track velocity measurements from either or both centrally located optical encoder sensors 48*b* and 48*e*, the controller 30 can determine whether the cross-track expansion or contraction takes place about an centroid 82 that is located at the cross-track midpoint 84 of the print medium 14 or whether, due to an asymmetric application of ink to the print medium 14, the centroid 82 of the cross-track expansion is shifted away from the cross-track midpoint 84 of the print medium 14. The controller 30 can them adjust the cross-track positioning and print width corrections to account for the asymmetric cross-track expansion or contraction of the print medium 14.

The preceding description illustrated how the optical encoder sensor outputs may be analyzed to identify various receiver media skew, rotation, and expansion and contraction phenomena. While each of the phenomena were discussed individually, they can occur concurrently, and the controller 30 through the analysis of the optical encoder sensor outputs can through the analyses described can determine the magnitude and direction of each phenomena.

Media distortion, which is dependent upon image data content, has a detrimental effect on color registration within a page even if the colors all start printing on top of each other at the top of the page. This distortion may be measured and corrected real time by application of the multi sensor detection schemes described herein. It is appreciated that the system controller of high speed printers can permit the writing system to respond in real time to localized media expansion or contraction in both the in-track and cross-track directions if the proper feedback is available. Skew between the media and the printheads may be a result of asymmetric media distortion.

The use of two or more optical encoder sensors 48 that measure in two orthogonal directions as least one of receiver media displacement or velocity enables the controller 30 to identify a number of receiver media motion characteristics, such as skew, rotation of the receiver media, and both in-track and cross-track media expansion or contraction. In some embodiments the coordinate axis of the optical encoder sensors 48 are rotated relative to the in-track and cross-track axis of the printing system 10. In a preferred embodiment, the coordinate axis of the optical encoder sensors 48 are rotated approximately 45 degrees relative to the in-track axis that is to the nominal direction of receiver media travel. Such a rotation of the optical encoder sensor coordinate axis can reduce aliasing errors that can affect the measurement of in particular the cross-track measurements of the receiver media motion.

Optical encoder sensors 48 provide a non-contact mechanism for monitoring the motion of the print medium 14 with high response rates. The low cost of the image correlation based optical encoder sensors 48 makes them an attractive encoder option. However, the precision of the image correlation based optical encoder sensors is not ideal. It is therefore desirable to have some method to calibrate them. One method for calibrating these encoders is to periodically mark the print medium with a defined spacing between the marks. US patent application Ser. No. 13/941,768 entitled Media-Tracking System Using Thermally-Formed Holes; Ser. No. 13/941,804 entitled Media-Tracking System Using Deformed Reference Marks; Ser. No. 13/941,733 entitled Media-Tracking System Using Thermal Fluorescence Quenching; and Ser. No. 13/941,713 entitled Media-Tracking System Using Marking Heat Source each filed Jul. 15, 2013 and commonly assigned, provide effective means to carry out the calibration.

The present invention has been described in detail with particular reference to certain preferred embodiments thereof, but it will be understood that variations and modifications can be effected within the spirit and scope of the invention.

PARTS LIST

10 printing system
12 print module
14 print medium
16 direction of travel
17 cross-track direction
18 dryer
20 imaging system
22 imaging devices
24 endless belt
26 drive roller
28 motor
30 controller
32 transport system
34 idler roller
35 leading edge
36 print media unit
37 trailing edge
38 printhead
38A-38F printheads
40 nozzle array
41 print zone
42 printing regions
43 print zone
44 overlap region
46 centerline
48 optical encoder sensor
48*a*-48*f* optical encoder sensor
50 blower
52 enclosure
54 opening
56 air flow
58 lens
60 heater
62 support structure
64 cue sensor
80 skew angle
82 centroid of expansion
84 cross track mid-point

The invention claimed is:

1. A printing system comprising:

at least one print module for printing on a print medium;

a mechanism for moving the print medium past the at least one print module;

at least a first and second optical encoder sensor for measuring at least one of displacement and velocity of the print medium which provides an output signal to a controller; wherein the controller, in response to the signals received from the at least two optical encoder sensors, controls the operation of the at least one print module, wherein each of the first and second optical encoder sensors is oriented to direct light toward the print medium, detect the light scattered off the print medium, and, based on analysis of the detected light, provide a measure of at least one of displacement of the print medium and velocity of the print medium.

2. The printing system as in claim 1, wherein at least one optical encoder sensor is positioned upstream of a print zone of the print module, and at least one optical encoder sensor is positioned downstream of the print zone of the print module.

3. The printing system as in claim 1, wherein the at least two optical encoder sensors are attached to the at least one print module.

4. The printing system as in claim 3, wherein the at least two optical encoder sensors are in line with each other and parallel to a direction of movement of the receiver media relative to the print module.

5. The printing system as claim 1, further comprising a third optical encoder sensor.

6. The printing system as claim 5, wherein each of the first, second and third optical encoder sensors measure in two directions of the at least one of the displacement and velocity of the print medium.

7. The printing system as in claim 5, wherein the first, second and third optical encoder sensors have a coordinate system direction that is skewed approximately 45 degrees relative to a nominal direction of motion of the receiver.

8. The printing system as in claim 5 further comprising a fourth optical encoder sensor.

9. The printing system as claim 8, wherein each of the first, second, third and fourth optical encoder sensors measure in two directions of the at least one of the displacement and velocity of the print medium.

10. The printing system as in claim 8, wherein the first, second, third and fourth optical encoder sensors have a coordinate system direction that is skewed approximately 45 degrees relative to a nominal direction of motion of the receiver.

11. The printing system as claim 1, wherein each of the first and second optical encoder sensors measure in two directions of the at least one of the displacement and velocity of the print medium.

12. The printing system as in claim 11, wherein the controller determines paper skew and cross-track media distortion in response to the two dimensional measurements from each of the first and second optical encoder sensors of the at least one of the displacement and velocity of the print medium.

13. The printing system as in claim 1, wherein the first and second optical encoder sensors have a coordinate system direction that is skewed approximately 45 degrees relative to a nominal direction of motion of the receiver.

14. The printing system as in claim 1 further comprising a heater for heating the first and second optical encoder sensors to prevent condensation on the first and second optical encoder sensors.

15. The printing system as in claim 1, wherein the first and second optical encoder sensors are disposed between two different print modules to determine registration of the print modules.

16. The printing system as in claim 1, wherein the first and second optical encoder sensors produce an output signal upon detection of a leading edge or a trailing edge of the receiver.

17. The printing system as in claim 1, wherein the controller controls a cross-track component of stitching of adjacent print heads within a print module in response from signals from the first and second optical encoder sensors.

18. The printing system as in claim 1, wherein the controller stores calibration data to calibrate the first and second optical encoder sensors relative to each other.

19. The printing system as in claim 1, wherein the first and second optical encoder sensors comprise optical encoder sensors that direct light onto a surface of the print medium and detect reflected light and use image correlation to determine motion.

20. The printing system as in claim 1, wherein the first and second optical encoder sensors comprise optical encoders that direct light onto a surface of the print medium and detect reflected light and use detection of Doppler shifted light to determine velocity of the print medium.

* * * * *